United States Patent [19]

McKenzie

[11] 4,415,218

[45] Nov. 15, 1983

[54] SPRING LOADED DIODE CONTACT APPARATUS

[75] Inventor: Robert W. McKenzie, Lewisville, Tex.

[73] Assignee: Rockwell International Corporation, El Segundo, Calif.

[21] Appl. No.: 476,890

[22] Filed: Mar. 18, 1983

Related U.S. Application Data

[63] Continuation of Ser. No. 235,293, Feb. 17, 1981, abandoned.

[51] Int. Cl.[3] ..... H01R 13/66

[52] U.S. Cl. ..... 339/147 R; 339/255 R; 339/255 RT

[58] Field of Search ..... 339/89 R, 89 C, 89 M, 339/255 R, 255 B, 255 L, 255 P, 255 RT, 147 R

[56] References Cited

U.S. PATENT DOCUMENTS

| | | | |
|---|---|---|---|
| 2,958,020 | 10/1960 | Eannarino | 339/255 R |
| 3,670,292 | 6/1972 | Tracy | 339/147 R |
| 3,864,005 | 2/1975 | Klein | 339/255 R |
| 4,293,176 | 10/1981 | Lindlof | 339/255 R |

FOREIGN PATENT DOCUMENTS

| | | | |
|---|---|---|---|
| 2262393 | 6/1974 | Fed. Rep. of Germany | 339/255 R |
| 1187077 | 4/1970 | United Kingdom | 339/255 B |

*Primary Examiner*—John McQuade
*Attorney, Agent, or Firm*—V. Lawrence Sewell; Howard R. Greenberg; H. Fredrick Hamann

[57] ABSTRACT

An apparatus is disclosed for establishing a reliable electrical connection with a diode. Contact with the diode is made by a conductor element which is generally cylindrical but also has a flared, conical portion. A biasing disc is provided which has a hole in the center and slits extending from the hole to form resilient leaf projections. The conductor element is assembled extending through the hole in the biasing disc, with the leaf projections deflected by the flared portion so as to resiliently press the conductor element against the diode.

4 Claims, 5 Drawing Figures

SPRING LOADED DIODE CONTACT APPARATUS

This application is a continuation of application Ser. No. 235,293, filed Feb. 17, 1981, now abandoned.

BACKGROUND OF THE INVENTION

This invention relates to an apparatus for making highly stable and reliable contact, suitable for radio frequency circuit operation, with a component such as a varactor diode or Gunn diode. A prior art assembly which has been used to make contact with such diodes includes a mounting plate assembly and a threaded contact which can be screwed into position to bear against the diode and thus make electrical contact with it. One of the problems with this design is that the threaded contact can stress the diode, breaking it. Another problem is the potential loss of electrical contact with the diode due to thermal expansion and contraction.

SUMMARY OF THE INVENTION

In accordance with the present invention, there is provided an apparatus in which contact with a diode is made by a conductor element that is generally cylindrical but also has a flared portion. There is a biasing disc of resilient sheet material which has a hole in the center and slits extending from the hole to form resilient leaf projections. An assembly is provided for mounting the conductor element extending through the hole in the biasing disc, with the leaf projections deflected by the flared portion so as to resiliently press the conductor element against the diode.

The spring action of the biasing disc provides sufficient pressure to afford good electrical contact, without overstressing the diode. In addition, the apparatus can maintain good electrical contact in the presence of thermal expansion and contraction.

In another aspect of the invention, a mounting assembly is provided which includes a mounting plate having a well formed in it, with the biasing disc seated at the bottom of the well. An annular capacitive element is disposed around the conducting element and holds the biasing disc in place against the bottom of the well. In yet another aspect of the invention, the mounting assembly has an annular radio frequency absorber disposed around the conducting element and holding the biasing disc in place against the well bottom. The latter assembly results in a considerably reduced part count compared with the prior art design.

DESCRIPTION OF THE PREFERRED EMBODIMENTS

Figure 1:
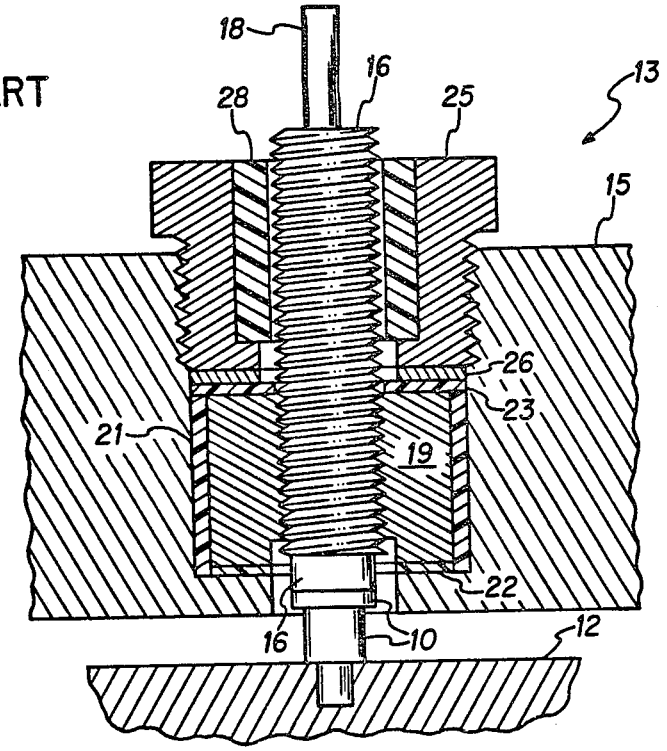
FIG. 1 PRIOR ART
FIG. 1 is a cross-sectional elevation view of a prior art diode contact assembly.

FIG. 1 shows a description of a prior art apparatus. A diode 10 is mounted in a base plate 12. A contact assembly generally indicated by the reference numeral 13 is in a mounting plate 15. A threaded contact 16 of electrically conducting material provides a connection between the diode 10 and the end 18 of the contact.

An annular capacitive element 19, which is for example of brass, is around the threaded contact 16. In fact, capacitive element 19 is threaded to receive the threads of contact 16. Capacitive element 19 is separated from mounting plate 15, which is typically of brass or aluminum, by an insulating sleeve 21. Capacitive element 19 is insulated from surrounding structures at either end by washers 22 and 23, which are for example of polyamide.

A mounting nut 25, for example of brass, is threaded into mounting plate 15 to hold the whole assembly in place. Separating mounting nut 25 and insulating washer 23 is a thrust washer 26, which is for example brass. Inset in mounting nut 25 is a radio frequency absorber 28 which absorbs radio frequency energy radiating from threaded contact 16.

Electrical connection between the threaded contact 16 and diode 10 is assured by screwing contact 16 in the threads of capacitive element 19 to press against the diode. It can be readily seen that thermal effects of expansion and contraction of the parts can cause the electrical connection between contact 16 and diode 10 to be interrupted. Attempts to overcome this by screwing the threaded contact 16 firmly against the diode can result in breakage of the diode.

Figure 2:
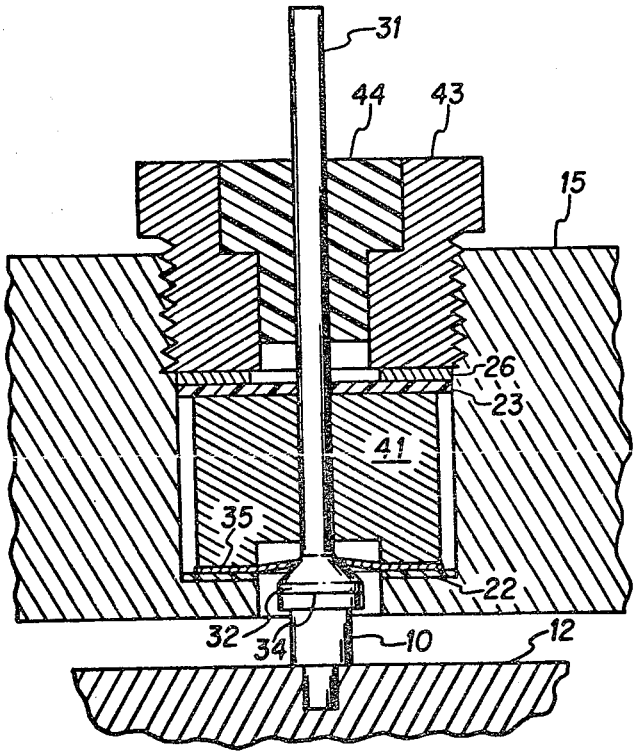
FIG. 2 is a cross-sectional elevation view of a diode contact apparatus in accordance with the invention.

FIG. 2 illustrates a diode contact apparatus in accordance with the invention. A conductor element 31 is generally cylindrical but has a flared or slanted portion formed of a frusto-conical section 32 near the end of the conductor element which contacts diode 10. Conductor element 31 has a flat surface 34 to conform to the flat upper surface of the diode 10 in the example. Diodes for which the apparatus of the invention can be used have various configurations; the surface 34 ofthe conductor element which makes contact with the diode should be shaped to conform sufficiently with the diode surface contacted that good electrical connection will be made.

Figure 3:
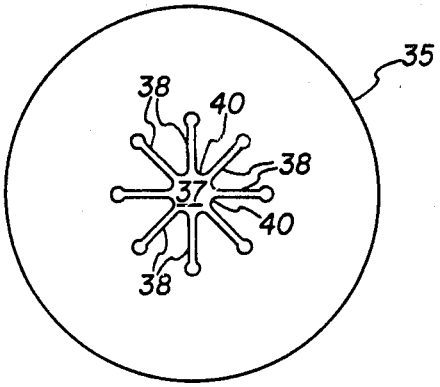
FIG. 3 is a plan view of a biasing disc for use in the apparatus of FIGS. 2, 4 and 5, in accordance with the invention.

The conductor element 31 is held against diode 10 by a biasing disc member 35, shown in plan view in FIG. 3. The member 35 is of a resilient sheet material, and has a central opening 37 with slits 38 radiating from the opening. The slits form resilient leaf projections 40 extending toward opening 37. In the example, there are eight such projections. In practice, such projections afford reliable spring contact with the sloping conical surface 32 of the conductor element 31. As can be seen in FIG. 2, the biasing disc member 35 is disposed in the assembly so that the resilient leaf projections 40 are deflected by the sloping portion 32 of the conductor element 31. This causes the projections 40 to impart a force to the conductor element 31 pressing it against diode 10. The biasing disc member can be formed by chemical etching, and is preferably heat treated and plated.

In the assembly of FIG. 2, a capacitive element 41 is included as in FIG. 1, although it is not threaded. Washers 22, 23 and 26 perform functions the same or similar to those of FIG. 1. A mounting nut 43 of conducting material and radio frequency absorber 44 perform the same functions as in FIG. 1. Although a part (biasing disc member 35) has been added in FIG. 2, the total parts count is kept the same as in FIG. 1, by eliminating sleeve 21, relying on the insulating effect of a space between capacitive element 41 and mounting block 15.

It can be understood that the spring action of the biasing member 35 holds the conductor element 31 against diode 10, despite changes in the parts due to thermal expansion and contraction. There is no need to compensate for such effects by a high pressure as with the screw contact 16 of FIG. 1. Accordingly, there is little if any danger of breaking diode 10.

It is important to emphasize that biasing disc manner 35 has another function in addition to pressing conductor element 31 against diode 10. The disc member 35 also provides electrical contact between conductor element 31 and capacitive element 41. The electrical contact achieved by the multiple resilient leaf projections 40 is very reilable. By contrast, in the assembly of FIG. 1, the effective point of electrical contact between capacitive element 19 and the threads of threaded element 16 is subject to considerable variation due to conditions such as thermal effects. This in turn affects the electrical operation of the assembly. In the apparatus of FIG. 2, the leaf projections of the disc member 35 establish a highly reliable and predictably located electrical connection between capacitive element 41 and the conductive element 31.

Figure 4:
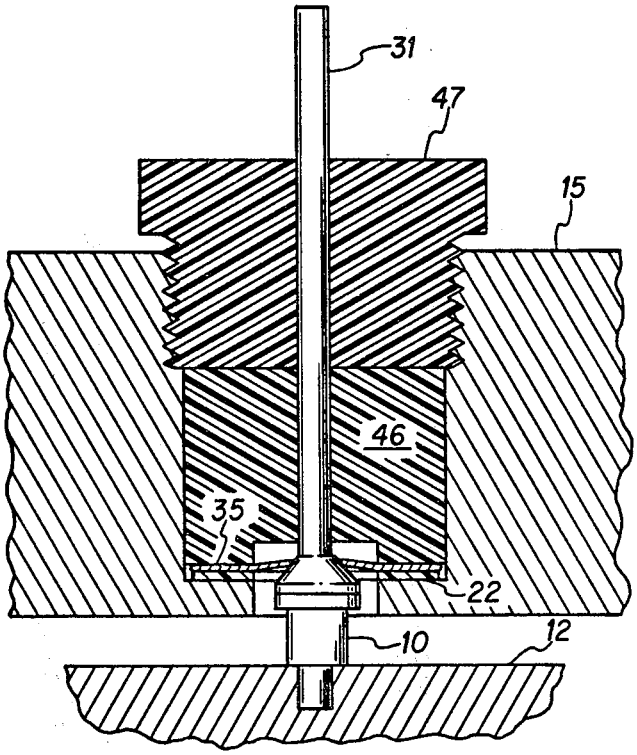
FIG. 4 is a cross-sectional elevation view of a second embodiment of an apparatus in accordance with the invention.

FIG. 4 illustrates an embodiment of the invention which has a reduced part count. In this apparatus, annular member 46 is a radio frequency absorber. This is typically an impregnated plastic, which is effectively an insulator at low frequencies. The absorber 46 bears against biasing disc member 35, just as in FIG. 2 to hold member 35 in place. An insulating mounting nut 47 holds absorber 46 and the rest of the assembly in position in the mounting plane 15. The parts count of the apparatus of FIG. 4 is reduced by three in comparison to the apparatus of FIG. 2. This can result in a substantial cost savings.

Figure 5:
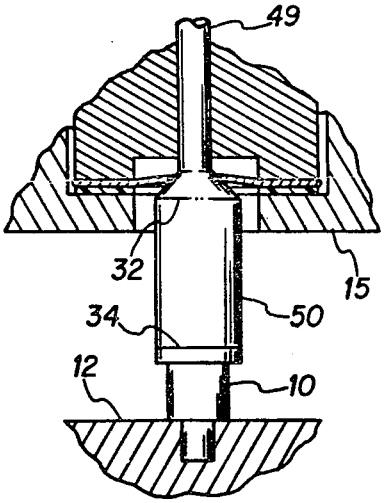
FIG. 5 is a partial cross-sectional elevation view of a third embodiment of an apparatus in accordance with the invention.

FIG. 5 illustrates an embodiment in which the distance between mounting plate 15 and base plate 12 is considerably greater than in the other examples. Conductor element 29 is modified compared to conductor element 31 in the other examples, to have a greatly extended portion 50 between the conical surface 32 and the surface 34 contacting diode 10. This and other modifications of the embodiment shown herein are possible, while still obtaining the basic advantages of the invention.

I claim:

1. Apparatus for establishing a highly reliable and stable electrical connection with a conducting surface of a circuit component, suitable for radio frequency circuit operation, comprising:

a conductor element having a surface for making electrical contact with the surface of the component as the conductor element is pressed along an axis against the component surface, and said conductor element further having a portion slated with respect to said axis;

means for establishing plural, stable points of contact with said slanted portion of the conductor element, including a biasing member formed of resilient sheet material with a first opening for receiving the conductor element therethrough, and having additional open portions formed therein to define a plurality of resilient leaf projections extending toward said first opening; and means for mounting said biasing member with the conductor element through said first opening thereof and with said biasing member disposed along said axis such that said leaf projections are deflected by and impart a force to said slanted portion of the conductor element, pressing said surfaces together.

2. Diode contact apparatus for establishing a highly reliable and stable electrical connection with a flat conducting surface of a diode, suitable for radio frequency circuit operation, comprising:

a conductor element having a substantial cylindrical portion, having a flat surface perpendicular to the axis of the cylindrical portion for bearing against the diode surface, and having a frusto-conical portion concentric with the cylindrical portion, the larger diameter of the frusto-conical portion being toward the flat surface of the element;

means for establishing plural, stable points of contact with said frusto-conical portion of the conductor element, including a biasing member formed of a resilient sheet material, with a first generally circular opening for receiving the conductor element therethrough, and having radial slits around said opening to define a plurality of resilient leaf projections extending toward said opening; and means for mounting said biasing member with the conductor element through said opening perpendicular to the sheet material of the biasing member, and with said biasing member disposed along said cylindrical axis such that said leaf projections are deflected by and impart a force to the frusto-conical portion of the conductor element, pressing said surfaces together.

3. The apparatus of claim 2, wherein said means for mounting includes:

a mounting plate having a well formed therein, with the biasing member seated at the bottom of the well, an annular capacitive element disposed around the conductor element and holding the biasing member in place against the well bottom, and an annular fastener around the conductor element for fastening to the mounting plate and holding the capacitive element in a fixed position, whereby said biasing member provides reliable electrical contact between said conductor element and said capacitive element.

4. The apparatus of claim 2, wherein said means for mounting includes:

a mounting plate having a well formed therein, with the biasing member seated at the bottom of the well, an annular radio frequency absorber disposed around the conductor element and holding the biasing member in place against the well bottom, and an annular fastener around the conductor element for fastening to the mounting plate and holding the absorber in a fixed position.

* * * * *